US006083045A

United States Patent [19]

Chiu

[11] Patent Number: 6,083,045

[45] Date of Patent: Jul. 4, 2000

[54] ELECTRICAL CONNECTOR

[75] Inventor: Allen Chiu, Taipei, Taiwan

[73] Assignee: Hon Hai Precision Ind. Co., Ltd., Taipei Hsien, Taiwan

[21] Appl. No.: 09/322,290

[22] Filed: May 28, 1999

[30] Foreign Application Priority Data

Jan. 12, 1999 [TW] Taiwan ..... 88200436

[51] Int. Cl.[7] ..... H01R 13/66

[52] U.S. Cl. ..... 439/570

[58] Field of Search ..... 439/570, 562, 439/563, 566, 571, 83

[56] References Cited

U.S. PATENT DOCUMENTS

| | | | |
|---|---|---|---|
| 5,186,654 | 2/1993 | Enomoto | 439/570 |
| 5,232,379 | 8/1993 | Lai | 439/570 |
| 5,591,047 | 1/1997 | Yamada | 439/541.5 |
| 5,622,519 | 4/1997 | Bixler | 439/570 |
| 5,961,347 | 10/1999 | Hsu | 439/570 |

*Primary Examiner*—Gary F. Paumen
*Assistant Examiner*—P. Nguyen
*Attorney, Agent, or Firm*—Wei Te Chung

[57] ABSTRACT

An electrical connector comprises an elongate dielectric base having a base body and a pair of latching sections on opposite ends of the base body, a number of contacts received in the base body and a positioning device. Each contact comprises an engaging end received in the base and a soldering end for being soldered to a circuit board. The positioning device has a pair of positioning members fixed to the latching sections. Each positioning member is integrally stamped from a metal sheet and has a main body and a pair of securing sections symmetrically extending from opposite ends of the main body. Each securing section forms one, two or more bends relative to the main body for latching in the corresponding recess of the latching sections of the housing. The positioning device is attached to the latching sections through cooperation between symmetrical configurations and dimensions thereby simplifying manufacture and reducing costs.

1 Claim, 7 Drawing Sheets

ELECTRICAL CONNECTOR

BACKGROUND OF THE INVENTION

The present invention relates to an electrical connector, and particularly to an electrical connector having a positioning device with at least two identical positioning members for assisting in mounting the connector to a printed circuit board.

An electrical instrument commonly use myriad electrical connectors for accomplishing electrical connections between inner components of the electrical instrument or between systems for signal transmission and power transfer. Methods for fixing an electrical connector to a mating circuit board usually adopt Through Hole Technology (THT) or Surface Mount Technology (SMT).

The method of THT requires a plurality of through holes in the circuit board for receiving soldering ends of corresponding contacts of the connector therein. These through holes reduce the valuable space of the circuit board (which usually is a multi-layer board) for accommodating circuit lines.

The SMT directly welds soldering ends of corresponding contacts of the connector to a face of the circuit board on which the connector is mounted. Thus, more circuitry lines can be accommodated in the arranged circuit board in comparison with the THT, thereby enabling a design engineer to more conveniently arrange the circuit layout in the circuit board. To help the connector to be securely mounted on the circuit board, positioning devices in the form of soldering pads have been introduced to be fixed to the housing of the connector. The positioning devices are soldered to the circuit board by SMT thereby enhancing the connecting strength between the connector and the circuit board.

A conventional SMT type electrical connector is disclosed in U.S. Pat. No. 5,232,379. As shown in FIG. 1, a soldering pad 10 cooperates with another soldering pad (not shown) having a different configuration to constitute a positioning device for enhancing the mounting strength of the conventional electrical connector (not shown) to a circuit board. the soldering pad 10 has a L-shaped main body 12 comprising a horizontal section 14 and a vertical section 15. A bottom surface 13 of the horizontal section 14 is surface mounted to a mating circuit board (not shown) for fixing the connector. An upper side wall of the vertical section 15 is bent to form a U-shaped latching section 16 for attaching to an insulative housing of the connector. The latching section 16 includes a positioning body 18 parallel to the vertical section 15. The positioning body 18 forms a latching bar 22 for cooperating with the latching section 14 to attach the positioning device 10 to the connector thereby ensuring reliable electrical connection between the connector and the circuit board. each soldering pad has a complicated configuration. Furthermore, it needs two types of pressing die to form the two soldering pads. Thus, the cost for forming the positioning device is high.

Another conventional positioning device for an SMT type connector is disclosed in U.S. Pat. No. 5,186,654. The positioning device forms several barbs and latching bars for engaging with an insulative housing of a connector thereby facilitating soldering of contacts of the connector to a mating circuit board. However, the positioning device comprises a pair of members of different configurations, which require to be separately manufactured, to be fixed to opposite sides of the housing thereby increasing costs.

BRIEF SUMMARY OF THE INVENTION

A main object of the present invention is to provide an electrical connector with at least two identical positioning members thereby simplifying manufacturing procedures and decreasing costs.

In accordance with the present invention, an electrical connector comprises a dielectric base having latching sections on opposite sides thereof. A plurality of contacts are received in the base. A positioning device comprises at least a positioning member, which is substantially a soldering pad, attached to corresponding latching sections of the base. Each positioning member comprises a main body and a pair of securing sections symmetrically extending from opposite ends of the main body for securing to the base. In addition, the positioning device is symmetrically fixed to opposite ends of the base thereby simplifying manufacturing procedures and decreasing costs.

Other objects, advantages and novel features of the invention will become more apparent from the following detailed description when taken in conjunction with the accompanying drawings.

DETAILED DESCRIPTION OF THE INVENTION

Figure 1:
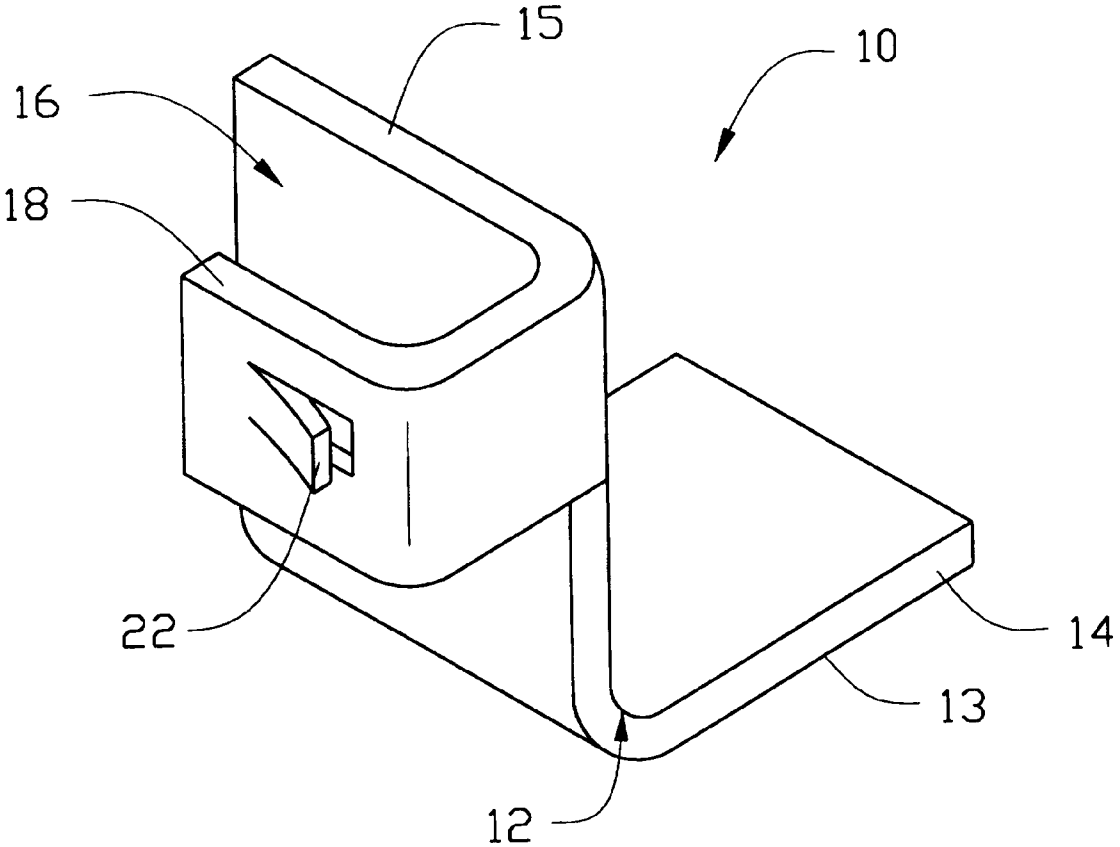
FIG. 1 (PRIOR ART)
FIG. 1 is a perspective view of a conventional positioning device.
Figure 2:
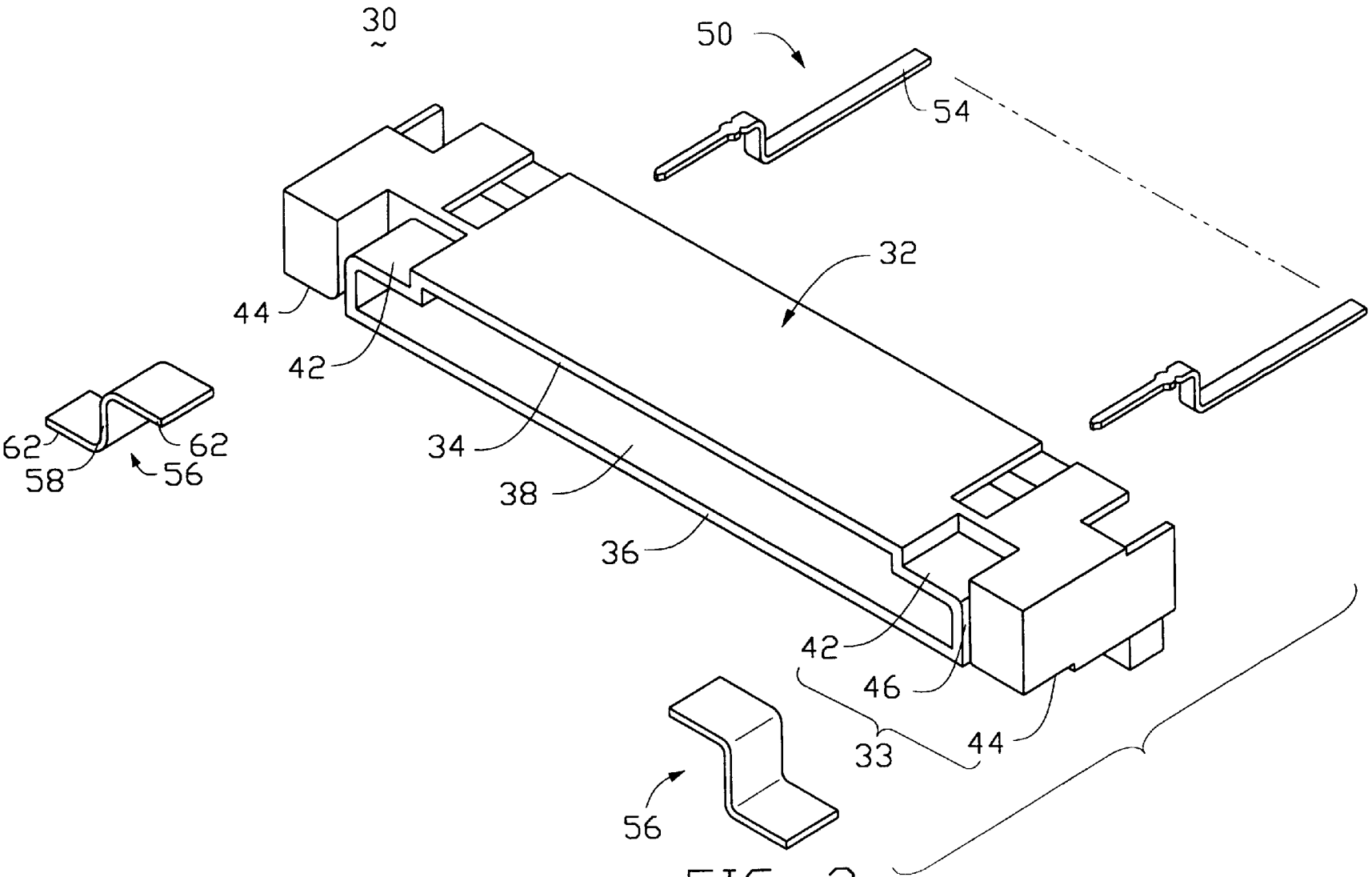
FIG. 2 is an exploded view of an electrical connector in accordance with a first embodiment of the present invention.
Figure 3:
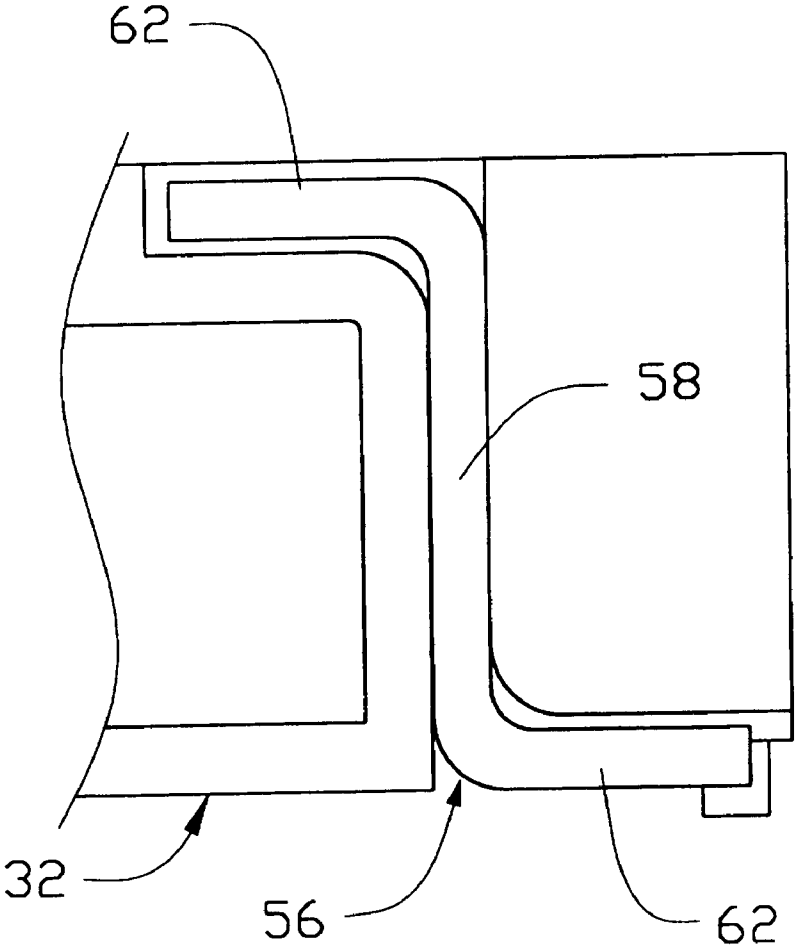
FIG. 3 is a partial, planar view of a positioning device assembled in a dielectric base of a connector in accordance with the first embodiment of the present invention.

Referring to FIGS. 2 and 3, an electrical connector 30 in accordance with the present invention comprises an elongate dielectric base 32, a plurality of contacts 50 received in the base 32 and a positioning device comprising a pair of identical positioning members 56 fixed proximate opposite ends of the base 32.

The base 32 forms a pair of latching sections 33 on opposite ends of the base body, an upper wall 34 and a lower wall 36. An engaging slot 38 is defined between the upper and lower walls 34, 36. Each positioning section comprises a slot 46, a first recess 42 and a second recess 44. The -first and second recesses 42, 44 communicate with the slot 46 at opposite ends thereof, respectively. The contacts 50 are deposited in the engaging slot 38 for electrically connecting a mating connector (not shown). Each contact 50 has a soldering section 54 on one end for being soldered to a corresponding contact pad of a mating circuit board (not shown).

Each positioning member 56 is integrally stamped and formed from a metal sheet and comprises a main body 58 and a pair of securing sections 62. A bend is formed at a junction between each securing section 62 and the main body 58, and perpendicularly bends from opposite ends of the main body 58 for latching in the corresponding recess 42, 44. The thickness of the main body 58 is substantially identical to the width of each slot 46. Thus, the main bodies 58 of the positioning members 56 can interferentially fit into the corresponding slot 46 of the latching section 33 thereby facilitating manufacturing procedures. Moreover, the symmetric configuration of the positioning members 56 further simplifies manufacturing procedures and decreases costs reducing the quantity of required components.

The positioning members 56 are attached to a side of the base opposite to the soldering sections 54 of the contacts 50. Thus, the positioning members 56 can provide a latching force which counter balances a soldering force provided by the soldering sections 54 when the contacts 50 are soldered to the mating circuit board thereby ensuring that the connector is steadily fixed on the mating circuit board.

Figure 4:
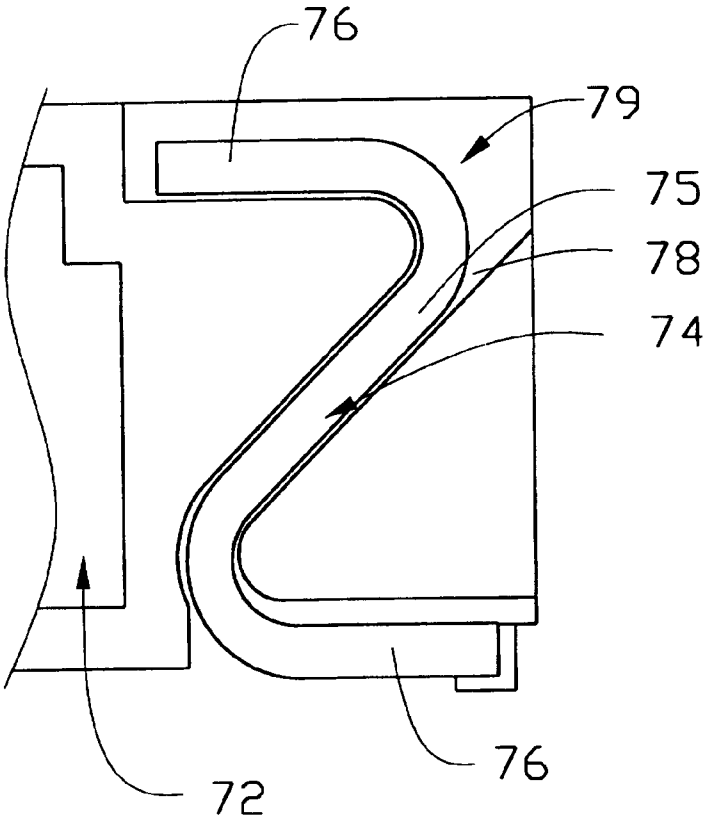
FIG. 4 is a partial, planar view of a positioning device assembled in a dielectric base of a connector in accordance with a second embodiment of the present invention.

FIG. 4 illustrates a positioning member 74 used with a connector in accordance with a second embodiment of the present invention. The essential function of the second embodiment is the same as the first embodiment. The positioning member 74 includes a pair of symmetrical securing sections 76. A bend is formed at a junction between each securing section 76 and the main body 75, and acutely bends from opposite ends of a main body 75 thereby forming a Z-shaped configuration. A latching section 79 of a base 72 of the connector forms an inclined slot 78 for interferentially receiving the main body 75 of the positioning member 74. Such a design can increase the contact area between the positioning members 74 and the corresponding latching sections 79 thereby providing a larger latching force to ensure that the positioning members 74 are securely fixed to the base 72.

Figure 5:
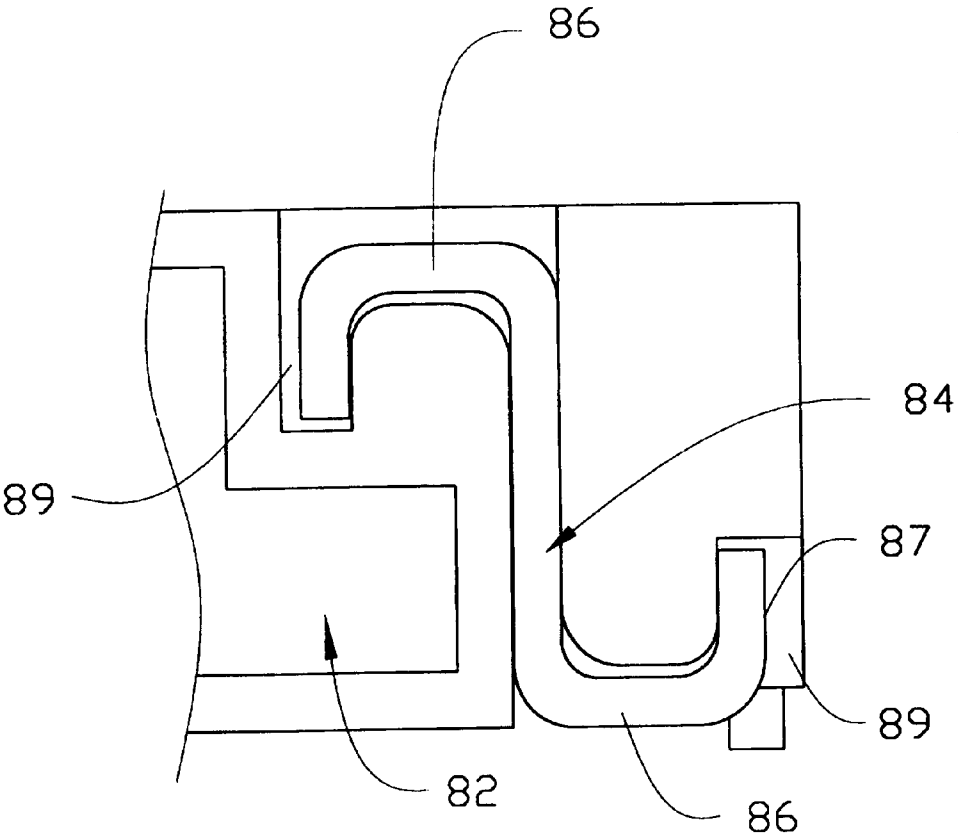
FIG. 5 is a partial, planar view of a positioning device assembled in a dielectric base of a connector in accordance with a third embodiment of the present invention.

FIG. 5 shows a positioning member 84 used with a connector in accordance with a third embodiment of the present invention. The positioning member 84 comprises a main body and a pair of L-shaped securing sections 86. Each securing section forms first and second bends. Each first bend is formed at a junction between each securing section 86 and the main body, and perpendicularly extends from opposite ends. The second bend is adjacent to the first bend and forms a free end 87. The free ends 87 extend toward a base 82 of the connector. A pair of receiving recesses 89 is defined in the base 82 for latching corresponding free ends 87 of the positioning members 84 thereby enhancing latching quality.

Figure 6:
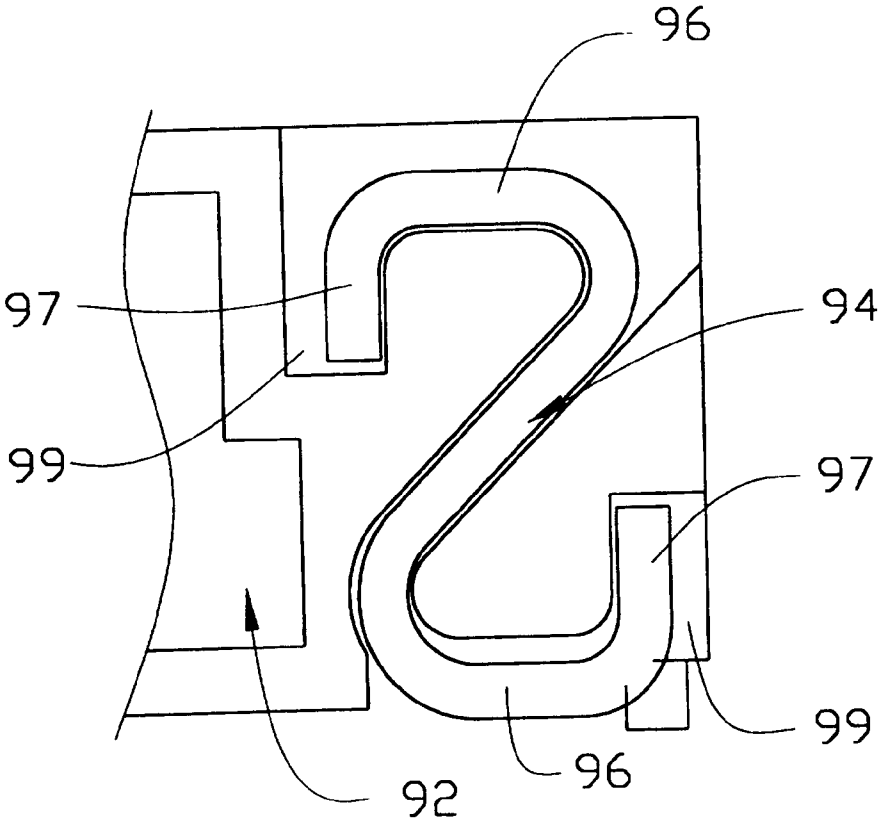
FIG. 6 is a partial, planar view of a positioning device assembled on a dielectric base of a connector in accordance with a forth embodiment of the present invention.

A positioning member 94 of a connector in accordance with a fourth embodiment of the present invention is illustrated in FIG. 6. The positioning member 94 comprises a main body and a pair of L-shaped securing sections 96 extending from opposite ends of the main body. Each securing section 96 forms first and second bends. Each first bend is formed at a junction between each securing section 96 and the main body, and acutely bends relative to the main body. Each second bend is adjacent to the first bend and forms a free end 97. The free ends 97 extend toward a base 92 of the connector. A pair of receiving recesses 99 is defined in the base 92 for engaging the free ends 97 of the positioning members 94 thereby enhancing latching quality.

Figure 7:
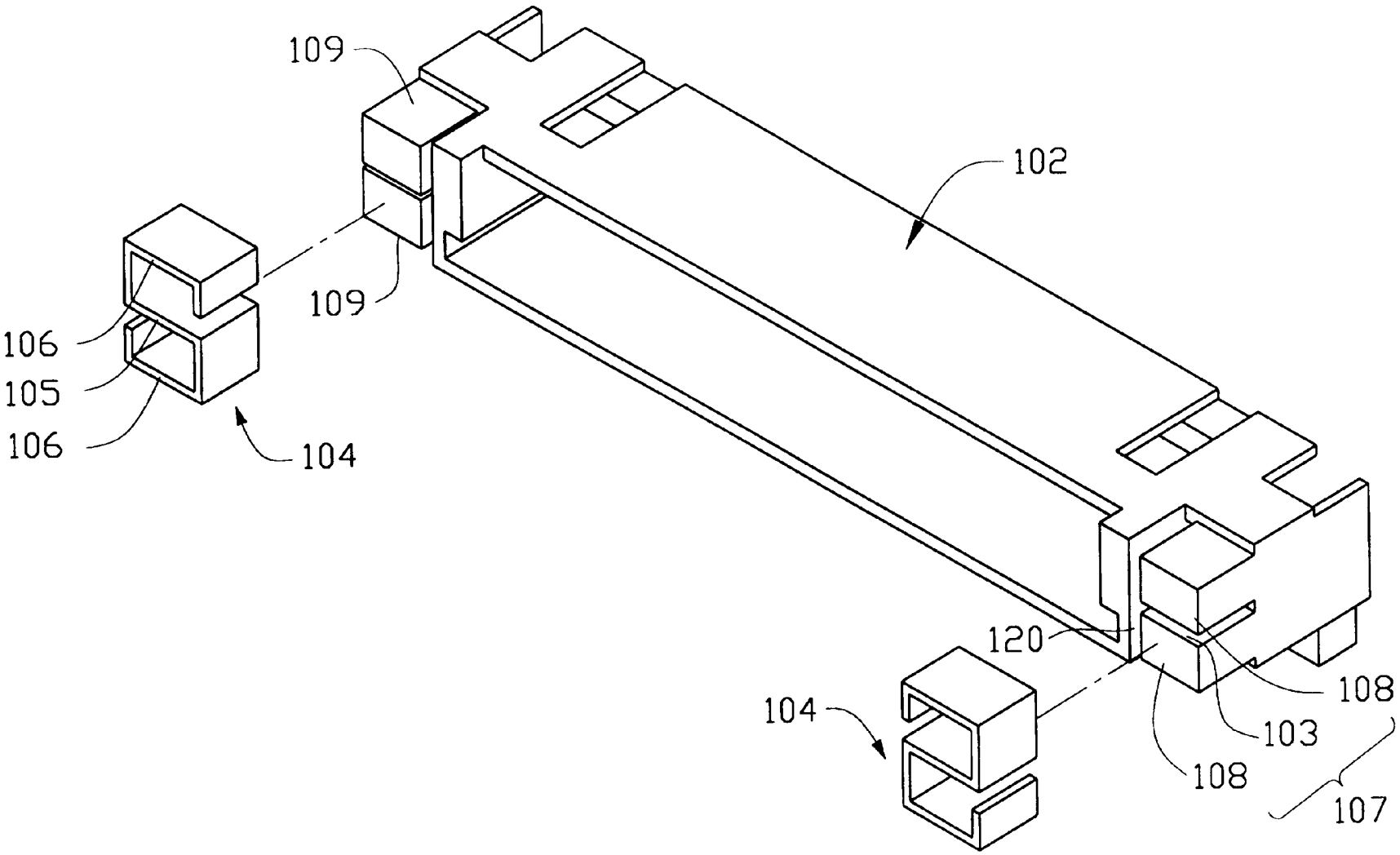
FIG. 7 is an exploded view of a positioning device and a dielectric base of a connector in accordance with a fifth embodiment of the present invention.

Referring to FIG. 7, a fifth embodiment of a connector having positioning members 104 is shown. The positioning member 104 comprises a main body 105 and a pair of U-shaped securing sections 106 extending from opposite ends of the main body 105. Each securing section 106 forms first, second, and third bends. Each first bend is formed at a junction between each securing section 106 and the main body 105, and perpendicularly bends relative to the main body 105. A pair of projecting blocks 108 is formed on each latching section 107 of a base 102 of the connector and each define a recess 109 thereon for receiving the securing sections 106. A slot 103 is defined between each pair of projecting blocks 108 for receiving the main body 105. The recesses and the slot 103 are parallel to each other. A fitting slot 120 is defined in the base 102, and is vertical to and communicates with the recesses 109 and the slot 103 for allowing the securing sections of the positioning members 104 to fluently fit into the corresponding latching sections 107 of the base 102.

Therefore, the positioning members in accordance with the present invention can be stamped and formed from a metal sheet to have symmetrical configurations thereby simplifying manufacture and decreasing costs. Moreover, configurations of the positioning members can be altered according to specific requirements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric base having a pair of latching sections on opposite ends thereof;

plurality of contacts received in the base body, each contact comprising an engaging end for mating with a mating connector and a soldering end for being soldered to a circuit board; and a positioning device comprising at least one positioning member, the at least one positioning member each comprising a main body fixed to a corresponding latching section and a pair of securing sections symmetrically extending from opposite ends of the main body;

wherein the latching sections are formed on a side of the dielectric housing opposite to the soldering ends of the contacts, each latching section comprising a slot and a pair of receiving recesses communicating with the slot for receiving the main body and the securing sections of the positioning device, respectively;

wherein a first bend is formed at a junction between each securing section and the main body, and a second bend and a third bend are formed on the securing section for securely latching to the receiving recess of the dielectric housing;

wherein the first, second, and third bends respectively form a right angle, and the slot of each latching section is parallel to the recesses for engaging corresponding main body therein;

wherein a fitting slot is defined in the dielectric base, and being vertical to and communicating with the recesses and the slot for allowing the securing sections of the positioning members to fluently fit into the corresponding latching sections.

* * * * *